US006155181A

United States Patent [19]

Chilcutt

[11] Patent Number: 6,155,181

[45] Date of Patent: Dec. 5, 2000

[54] SHIPPING PALLETS AND ACCESSORIES THEREFOR MADE OF CORRUGATED CARDBOARD AND CORRUGATED PLASTIC BOARD

[76] Inventor: Gordon F. Chilcutt, 13919 117th St. Ct. K.P.N, Gig Harbor, Wash. 98329

[21] Appl. No.: 09/187,052

[22] Filed: Nov. 5, 1998

Related U.S. Application Data

[60] Provisional application No. 60/065,041, Nov. 10, 1997.

[51] Int. Cl.[7] ..... B65D 19/00

[52] U.S. Cl. ..... 108/51.3; 108/56.1

[58] Field of Search ..... 108/51.3, 51.11, 108/56.1, 55.1, 57.18, 53.1, 53.3

[56] References Cited

U.S. PATENT DOCUMENTS

| | | | |
|---|---|---|---|
| 3,480,196 | 11/1969 | De Simas | 108/51.3 X |
| 3,519,190 | 7/1970 | Achermann et al. | 108/51.3 X |
| 4,354,599 | 10/1982 | Brown et al. | 108/53.1 X |
| 5,329,861 | 7/1994 | McCarthy | 108/51.3 |
| 5,350,066 | 9/1994 | Mendoza et al. | 108/51.3 X |
| 5,441,154 | 8/1995 | Youell, III | 108/51.3 X |
| 5,461,988 | 10/1995 | Cummings et al. | 108/51.3 |
| 5,531,166 | 7/1996 | Woods et al. | 108/51.3 |
| 5,535,668 | 7/1996 | Besaw et al. | 108/51.3 |
| 5,537,937 | 7/1996 | Juvik-Woods | 108/51.3 |
| 5,590,606 | 1/1997 | Crews et al. | 108/51.3 |
| 6,587,345 | 1/1996 | Winebarger et al. | 108/51.3 |

*Primary Examiner*—Jose V. Chen
*Attorney, Agent, or Firm*—Roy E. Mattern, Jr.

[57] ABSTRACT

Shipping and storage pallets and for handling goods and products are made of corrugated cardboard and corrugated plastic board arranged in respective vertically positioned side by side adhered laminations, which are die cut in respective patterns, to create both longitudinal members and transverse members, which are interfitted, via die cutout portions, to form a main pallet support. There are different sizes of different strengths and different configurations of these main pallet supports. Also the main pallet support, in addition to being shaped to receive tongs of a forklift, are also shaped to position different items of specific shapes, such as cylindrical shapes. Both the longitudinal members and transverse members, in some embodiments, include surrounding sleeves of wall corrugated materials. These various pallets are movable by using forklifts, preferably approaching in one of at least two different directions, which are perpendicular to one another. Also these various pallets are conveniently handled by using pallet jacks. Then when the useful life of each pallet is ended, the effective recycling of the corrugated materials is undertaken.

2 Claims, 13 Drawing Sheets

FIG. 8
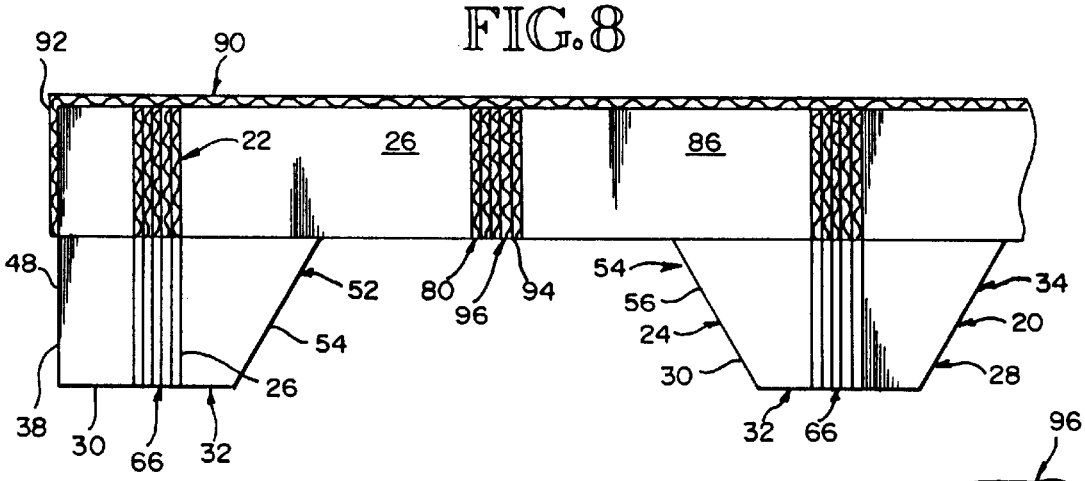
FIG. 9
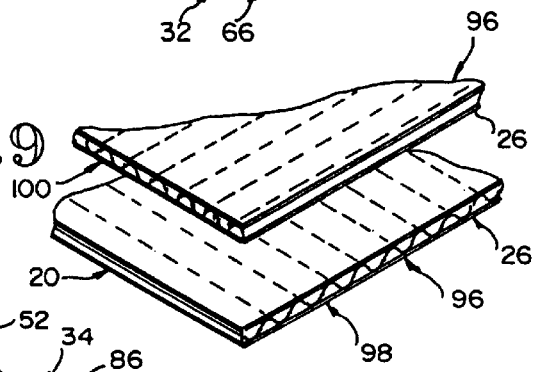
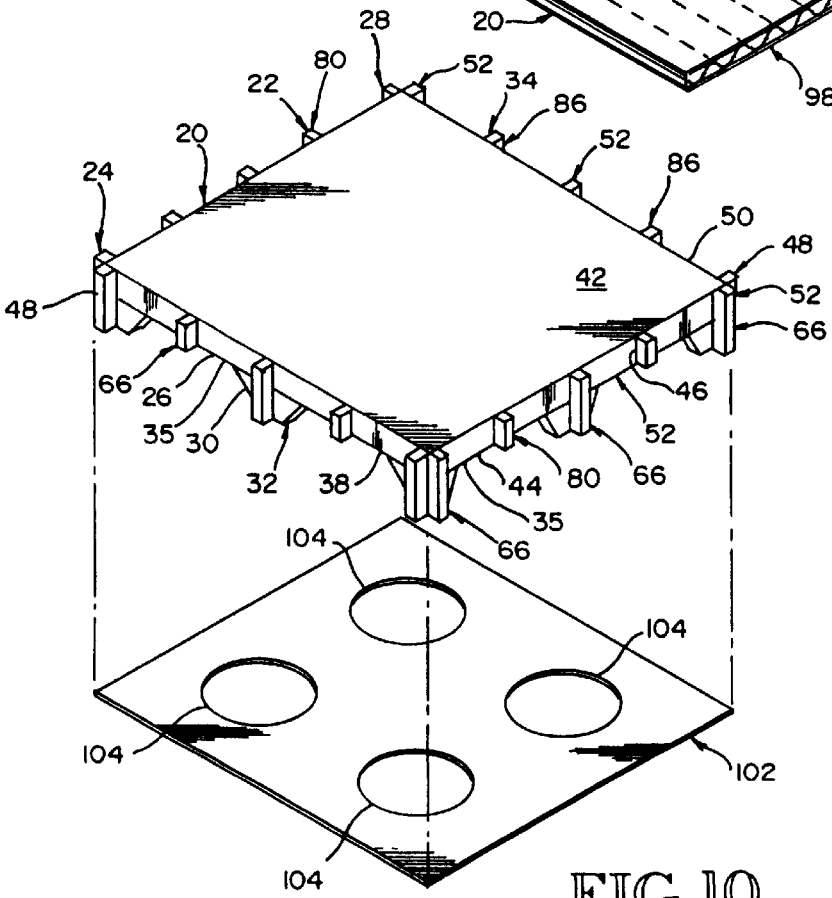
FIG. 10

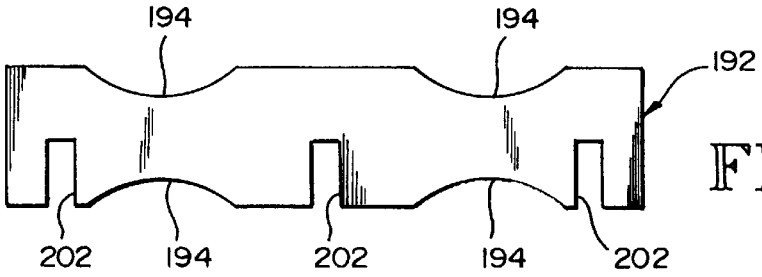
FIG. 34
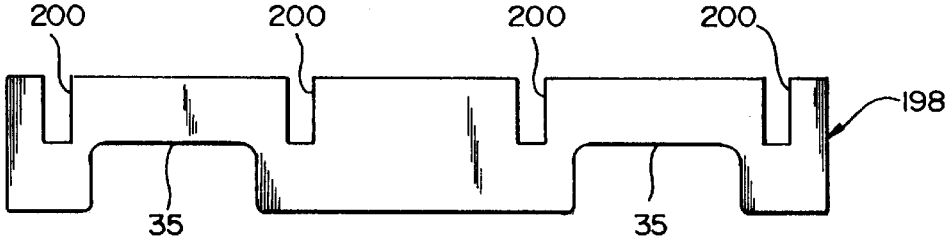
FIG. 35
FIG. 36
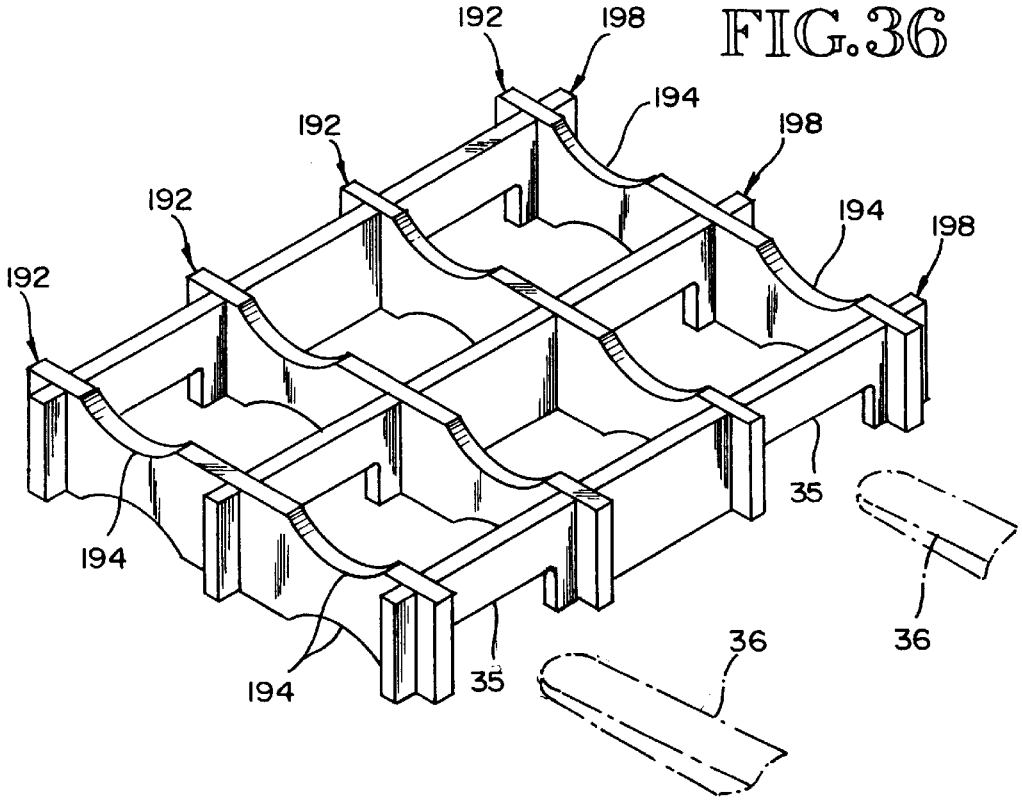

FIG. 38
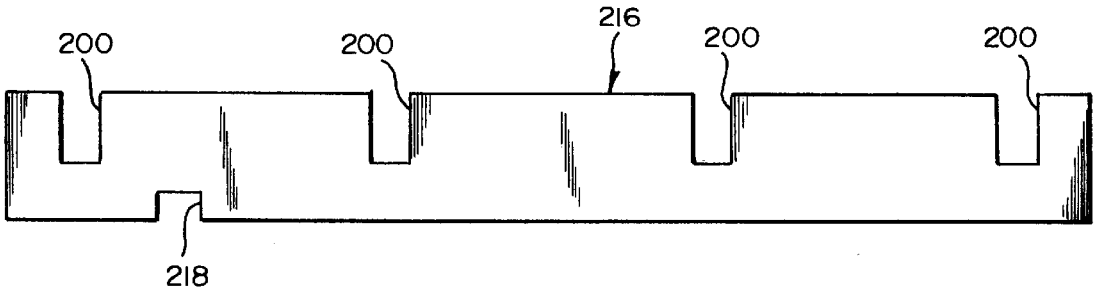
FIG. 39
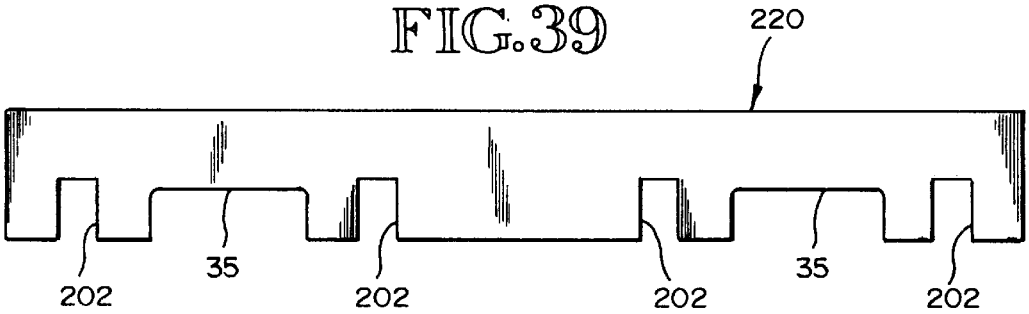
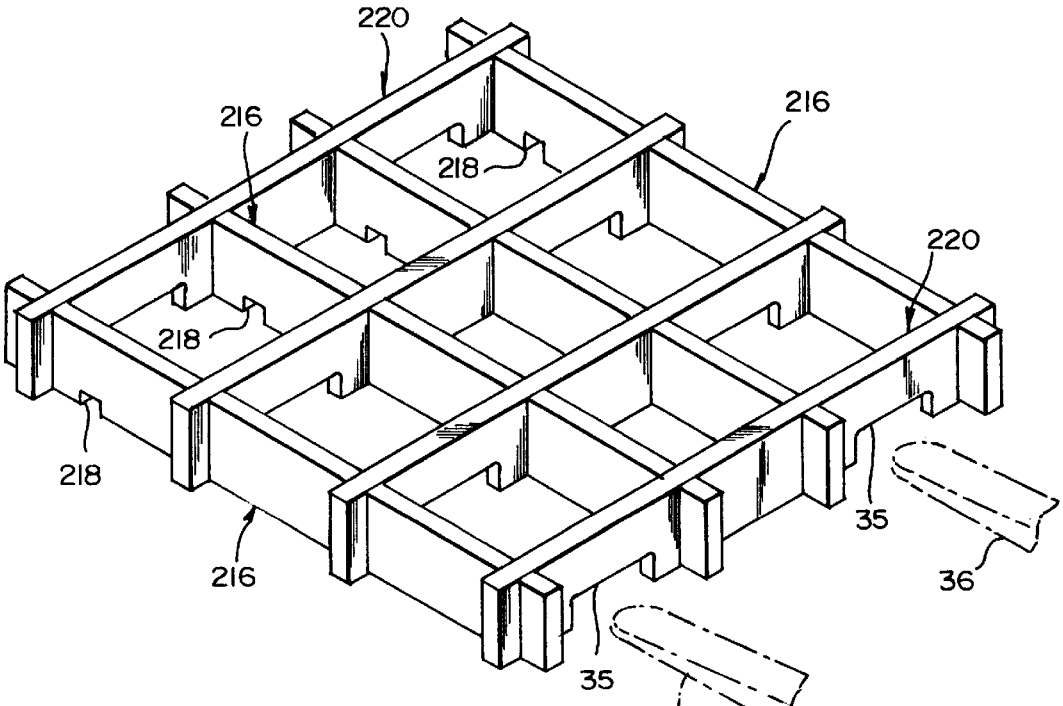
FIG. 40

SHIPPING PALLETS AND ACCESSORIES THEREFOR MADE OF CORRUGATED CARDBOARD AND CORRUGATED PLASTIC BOARD

CROSS REFERENCE

A Provisional application Ser. No. 60/065,041 was filed on Nov. 10, 1997, with the same title, by the same Applicant, and the priority is hereby claimed.

BACKGROUND

Shipping, handling, and storage pallets made from corrugated cardboard have been and are available. In comparison with wood pallets they are lighter, they tend to reduce product damage, they may be easily renewed, they may be conveniently recycled, and they do not support infestation. In respect to their comparative light weight corrugated cardboard pallets are handled by persons with greater ease, avoiding lifting sponsored injuries, for example, to one's back, and their use during shipping results in fuel and freight savings.

In reference to some United States patents which illustrate and describe the utilizations of corrugated cardboard.

In U.S. Pat. No. 4,487,136 of 1984, Bruce C. Beckway, discloses his pallet leg for a corrugated cardboard pallet which itself is made of corrugated cardboard;

In U.S. Pat. No. 4,792,325 of 1988, Joachim G. Schmidtke, illustrates and describes his method and apparatus for manufacturing cardboard pallets. Scored portions of corrugated cardboard are folded over and together creating runners, which are spaced apart and secured to spaced transverse stringers, also made of scored and folded over corrugated cardboard;

In U.S. Pat. No. 4,850,284 of 1989, Messrs. DeGroot, Kropedoski, Wakazek and Rivera, disclose their pallet and method of forming and securing pallet legs. Their pallet legs are optionally made of corrugated cardboard, soled fiberboard, or pasted chipboard, In U.S. Pat. No. 5,001,991 of 1991, Daniel A. Smith, illustrates and describes his corrugated constructions pallet assembly, which appears like the cardboard pallet set forth in U.S. Pat. No. 4,792,325. In addition, there are vertically positioned spaced cylindrical reinforcing pieces, which are also serving as legs for the pallet;

In U.S. Pat. No. 5,111,754 of 1992, Stephen C. Adams, Jr., discloses his portable shipping platform for use with slip sheet handling equipment and fork lifts. He combines the use of foam plastic, honeycomb paper, and/or corrugated paperboard to create his pallet;

In U.S. Pat. No. 5,154,687 of 1992, David K. Jeslis, illustrates and describes his rotary accumulated for pallet stringers or decking members. His machine glues, holds, and folds corrugated cardboard portions to create pallets stringers or decking members; and In reissue patent Re 34198 of 1993 based on U.S. Pat. No. 4,867,074 of 1989, Robert J. Quasnick, discloses his corrugated construction pallet. His decking members and stringers are comprised of scored corrugated cardboard folded over and moves closely together in a longitudinal configuration.

SUMMARY

In respect to the manufacture of shipping and storage pallets for handling goods and products, corrugated cardboard is die cut in many sizes and patterns. Also corrugated plastic board is likewise die cut in many sizes and patterns. Then the resulting pieces or laminations which are alike are adhered together in groups of at least two to form at least two lamination specific size and pattern member as it appears in an elevational view. Preferably, each group, or member, has either upstanding cutouts or depending cutouts, or some of each of these types of cutouts. Also some groups, or members, have depending continuous adhered laminations to serve as legs.

With this wide selection of various groups of adhered laminations, i.e. various members, then the design of many pallets of many overall sizes and overall strengths if readily and successfully undertaken. Each group is considered as being a load supporting member. Different groups are made to be either major transverses members or major longitudinal members which all have leg portions. Also different groups are made to be either minor transverse members or minor longitudinal members, which do not have leg portions.

When a selected number of groups, or members, are fitted together to meet a specification for a required or ordered pallet, them a main pallet support is successfully completed.

Also in respect to each group, the flutes of the corrugation adjacent to one another are selectively arranged to be either parallel or perpendicular to one another. When the flutes are so arranged perpendicular to one another, the pallet is stronger.

Accessories are available. A corrugated floor, or a corrugated plastic board floor, in two available types, is secured over the main pallet support to increase the strength of the pallet. However, most floors are used to keep smaller goods and/or products from falling through the spaces between the major load supporting members.

Also corrugated cardboard or corrugated plastic board of containers are placed over the major load supporting members, which may or may not include a floor, into which goods and/or products may be packed during handling, storage, and/or shipping. Preferably, these containers have knockdown assemblies of the top, sidewalls, and bottom. When they are not being used, the sidewalls are folded and placed between the top and bottom to form a reduced volume container assembly, awaiting the next in use period when the volume is increased.

When all these corrugated cardboards or corrugated plastics boards have served their useful commercial use, they are effectively recycled.

Other accessories, which are recycled, when no longer useful, in a different way and process, are formed plastic covers. They are sometimes specified to be snugly inserted over respective configurations of the corrugated cardboard laminated pallet legs. Their use is effectively undertaken, when these laminated corrugated cardboard pallets are to be supported on surface structures, which will have or may have some accumulation of water and/or moisture, and/or other liquids.

Also corrugated cardboard laminated pallet legs, in some embodiments receive a lanar piece of corrugated plastic board, or other like plastic materials, which serves as a protective sliding surface, and/or as a water barrier preventing moisture on a floor from entering these legs.

These pallets are offered in specific general purpose designs of various sizes and strengths to move and store many products which are packaged and/or bundled to be supported on a planar surface. For specific products, designs of these pallets are customized to interfit with the outer surface of these procuts, which often are not conveniently moved and stored while resting on a planar surface. Therefore, the transverse and/or the longitudinal members of a pallet are formed to match the exteriors of many products. Also, some pallets have lower receiving openings, which are aligned with other like openings of adjacent parallel members, either transverse or longitudinal members, so the pallet may be located in a pre-set position on a supporting frame assembly in a storage volume.

All of these pallets are movable by using forklifts and/or pallets jacks, which always are able to approach in a designated direction. Also many of these pallets are designed so a forklift and/or a pallet jack may approach from two directions.

DRAWINGS

FIGS. 4, 5, 6 and 7 are respective vertical elevational views of the four different respective longitudinal members or components, and transverse members or components, which in respective repeated numbers and in sequential times are interfitted to comprise the embodiment of the main pallet support, illustrated in FIGS. 1 through 10, and 15.

Figure 1:
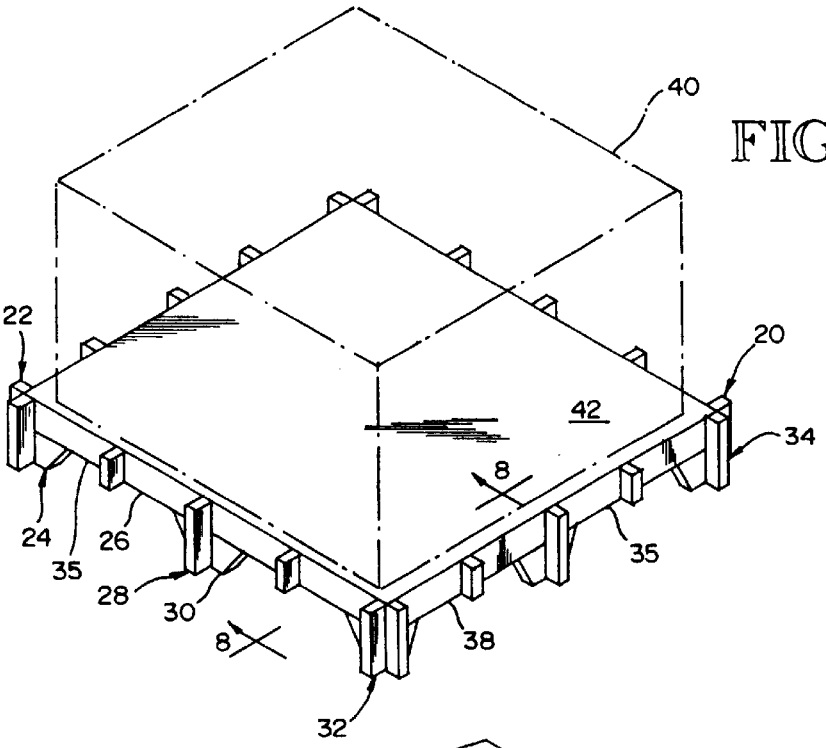
FIG. 1 is a perspective view of a main pallet support of a selected embodiment, having an optional floor, and illustrating by phantom lines an optional selected size volume to be filled with goods, which individually may be possibly much smaller in size, and therefore capable of otherwise falling through the members or components of the main pallet support, if an optional floor was not included.

FIG. 8 is a partial cross sectional view, taken along line 8—8 of FIG. 1, to illustrate the interfitting of portions of the main pallet support, shown in FIGS. 1 through 10, and 15, and illustrating how the corrugated cardboard is arranged in respective vertically positioned side by side laminations and die cut in respective patterns, as shown in FIGS. 4 through 7, and another optional floor accessory is illustrated which extends completely over both the longitudinal and transverse members, and it has a depending positioning flange.

FIG. 9 is a partial perspective view of portions of two corrugated materials, before their laminating joining, which have their flutes, forming the corrugations, arranged at right angles to one another, in contrast to the aligned flutes of the joined laminations illustrated in FIG. 8, indicating that, in selected embodiments, this cross fluting is undertaken to increase the strength of the overall main pallet support and other pallet supports of all of the respective embodiments.

FIG. 10 is a perspective view of a main pallet support having an optional floor, and also having an optional bottom, and this bottom is provided when this main pallet support will be used, when the pallet is to be moved along roller conveyors, while transporting products, confined on this pallet, and if pallet jacks are to be utilized before and afterwards, then clearance openings for pallet jack wheels, preferably circular, are made in this bottom, without interfering with the movement of the loaded pallet along a roller conveyor.

Figure 11:
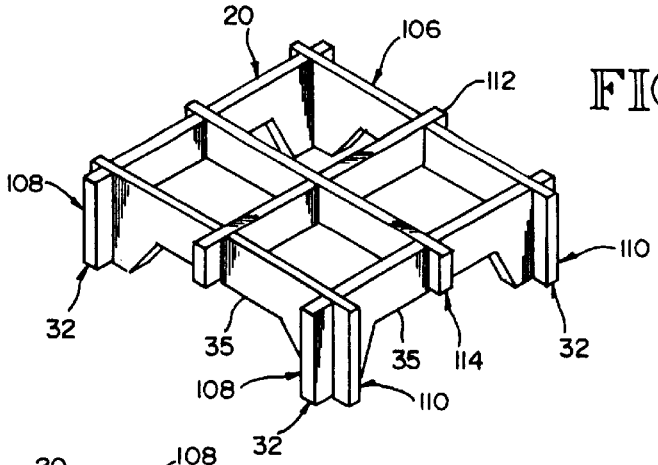

FIG. 11 is a perspective view of a smaller main pallet support having fewer members arranged in a square configuration.

Figure 12:
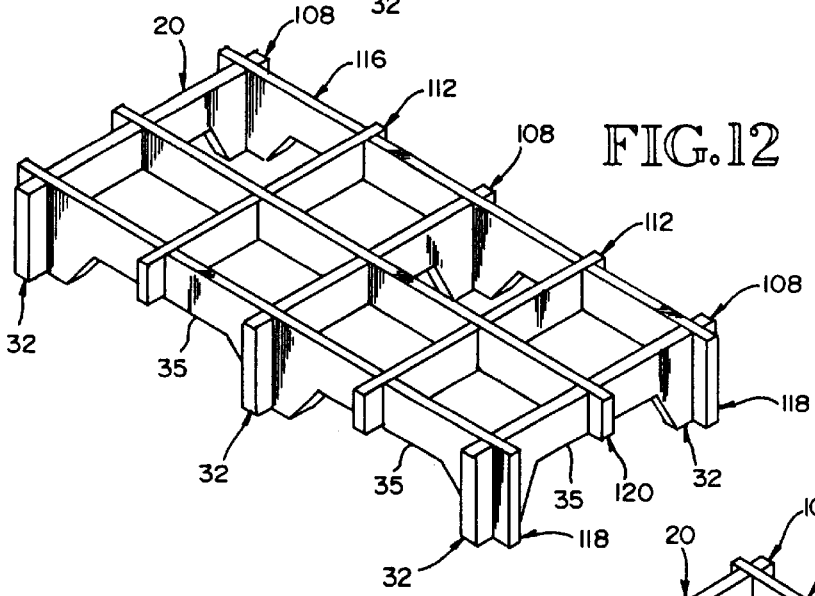

FIG. 12 is a perspective view of a little larger main pallet support, having fewer members, similarly arranged to the main pallet support, illustrated in FIG. 11, but arranged with additional members in a rectangular configuration, in effect becoming essentially two squares arranged adjacent one another.

Figure 13:
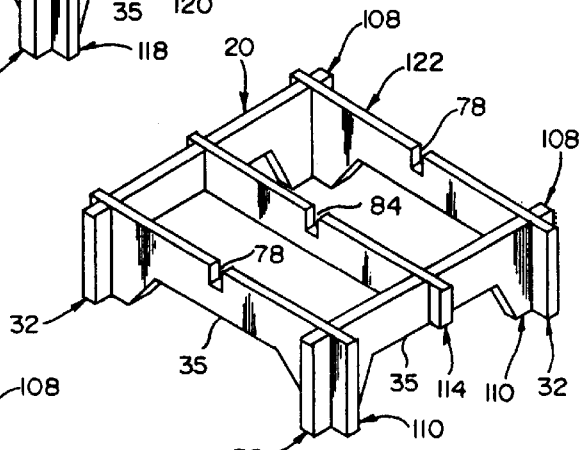

FIG. 13 is a perspective view of a smaller main pallet support, having fewer members and arranged in a square configuration.

Figure 14:
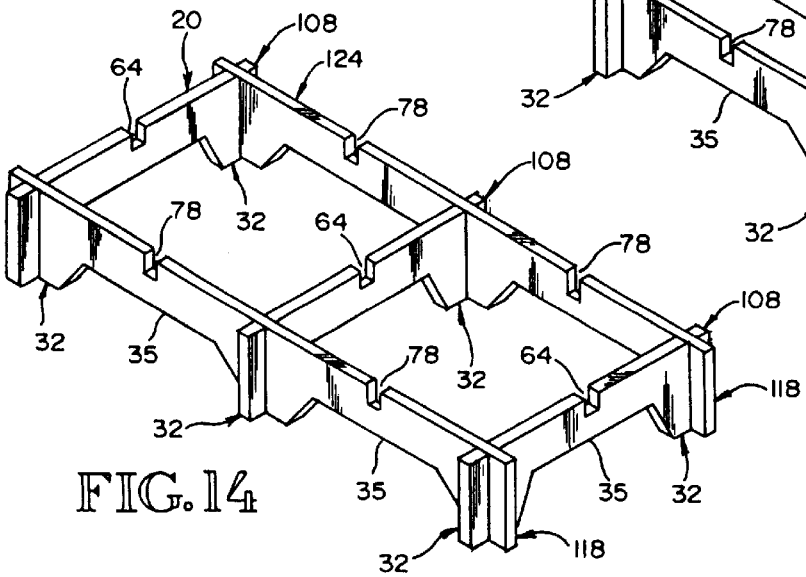

FIG. 14 is a perspective view of a little larger main pallet support having fewer members, similarly arranged to the main pallet support illustrate in FIG. 13, but arranged with additional members in a rectangular configuration, in effect becoming essentially two squares arranged adjacent one another.

Figure 2:
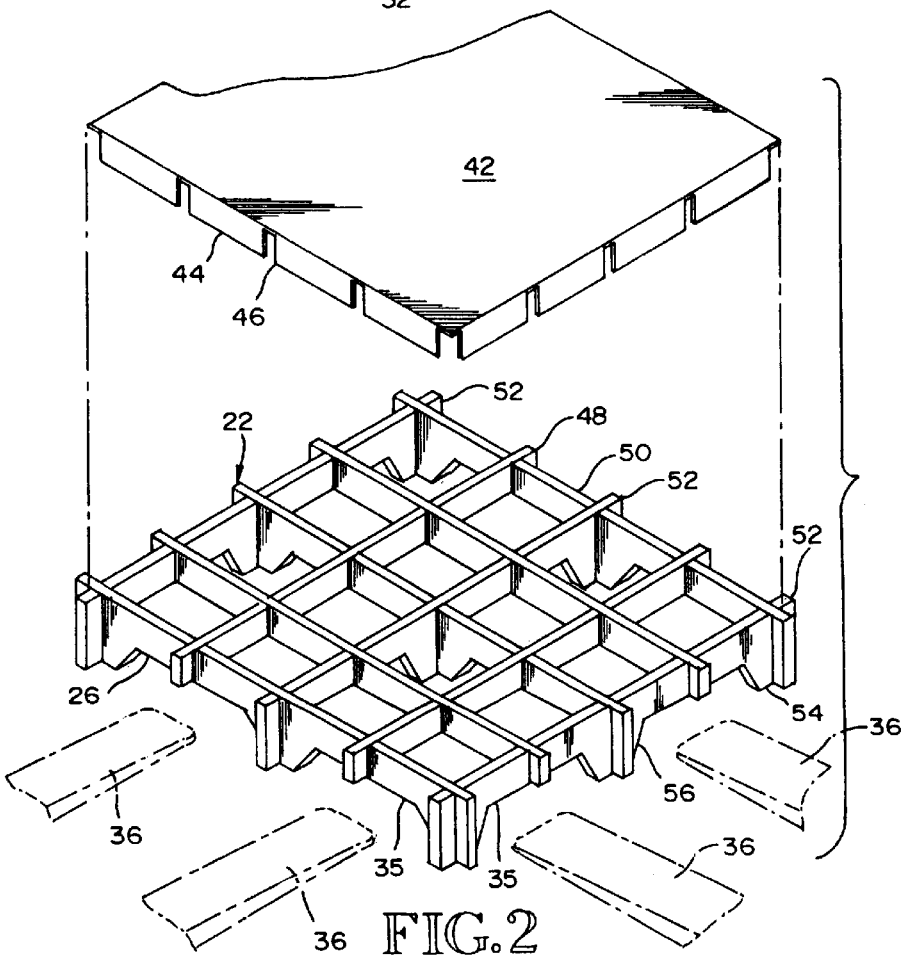
FIG. 2 is a partially exploded perspective view of the main pallet, illustrated in FIG. 1, and showing the optional floor about to be placed over and on the main pallet support, which in reference to larger size goods or products to be handled via the pallet, may not be considered necessary.
Figure 15:
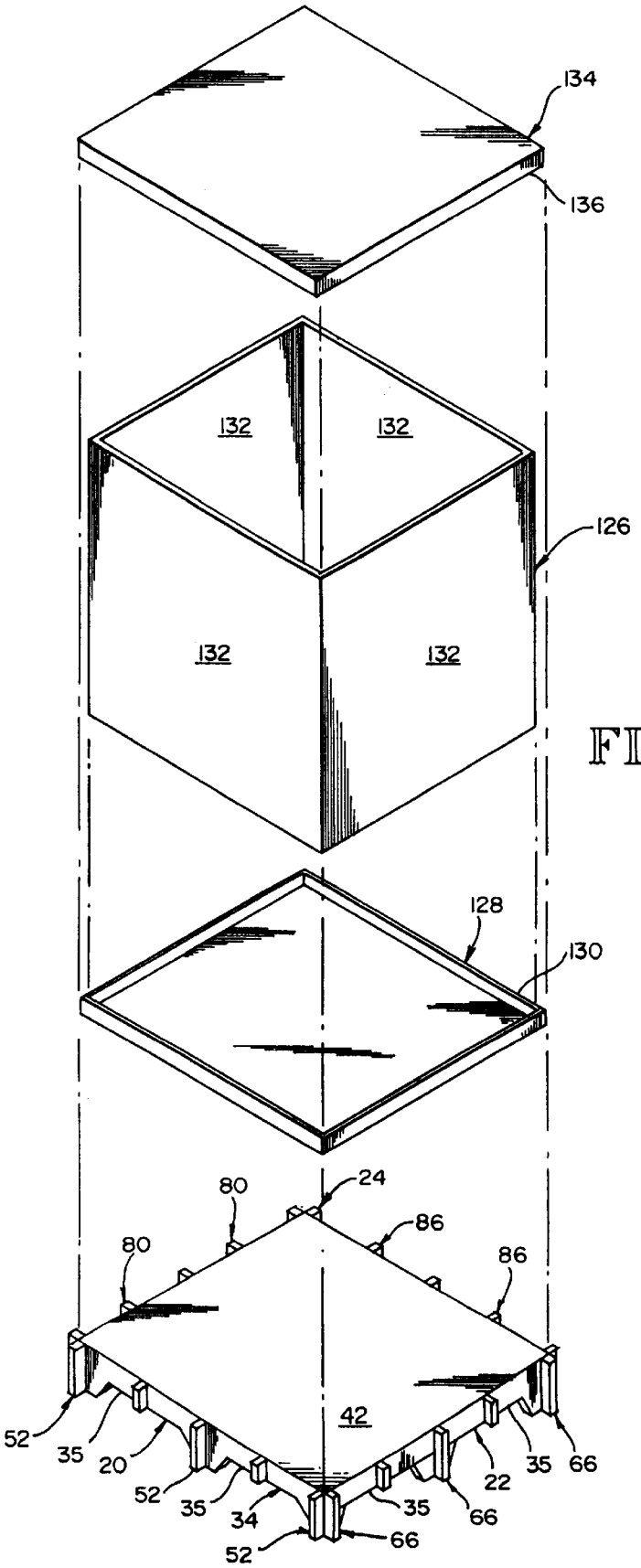

FIG. 15 is a perspective exploded view of the main pallet support, illustrated in FIGS. 1 and 2, which includes a packaging carton, as an accessory, having a carton top cover with a depending flange, a multiple side wall foldable subassembly, and a carton bottom having upturned flanges and in another accessory arrangement, if this bottom is turned over and lowered, the entire main pallet support is then covered around its top portions, as illustrated in FIG. 9, and then in some embodiments, any floor is not necessary, and in all carton embodiments, preferably the foldable subassembly of the multiple side walls, when not in use, may be folded up and placed between the carton top cover and the carton bottom for convenient protective storage, until the carton accessory is again needed.

Figure 16:
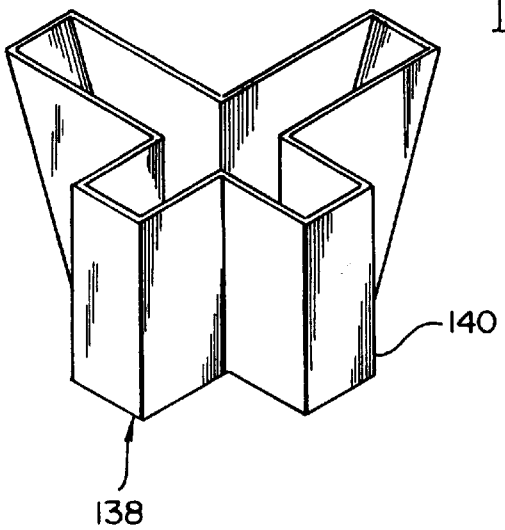
Figure 17:
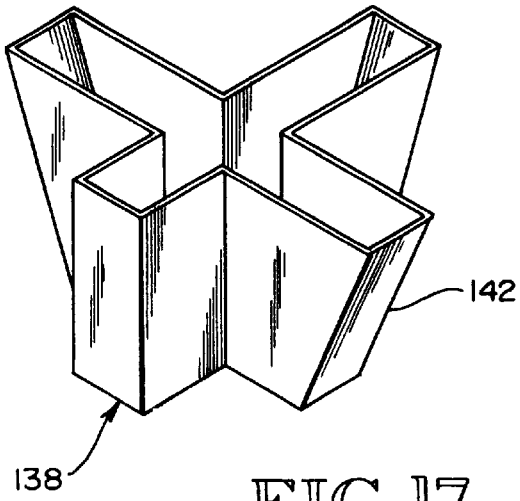
Figure 18:
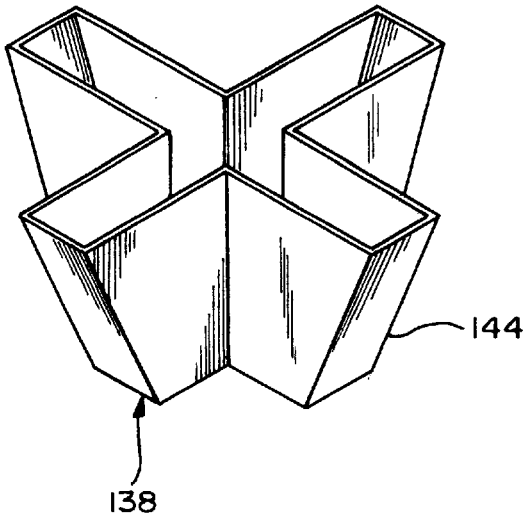

FIGS. 16, 17 and 18 are respective perspective views of the three sizes and configurations of respective plastic covers, optionally used at respective locations to snugly fit over the pallet leg portions to keep moisture and/or water and/or other liquids out of the corrugated cardboard materials, when pallets are to be handled and/or stored, where water or other liquids, may be present, or could later be present, extending over a supporting surface, upon which a pallet will be placed.

Figure 19:
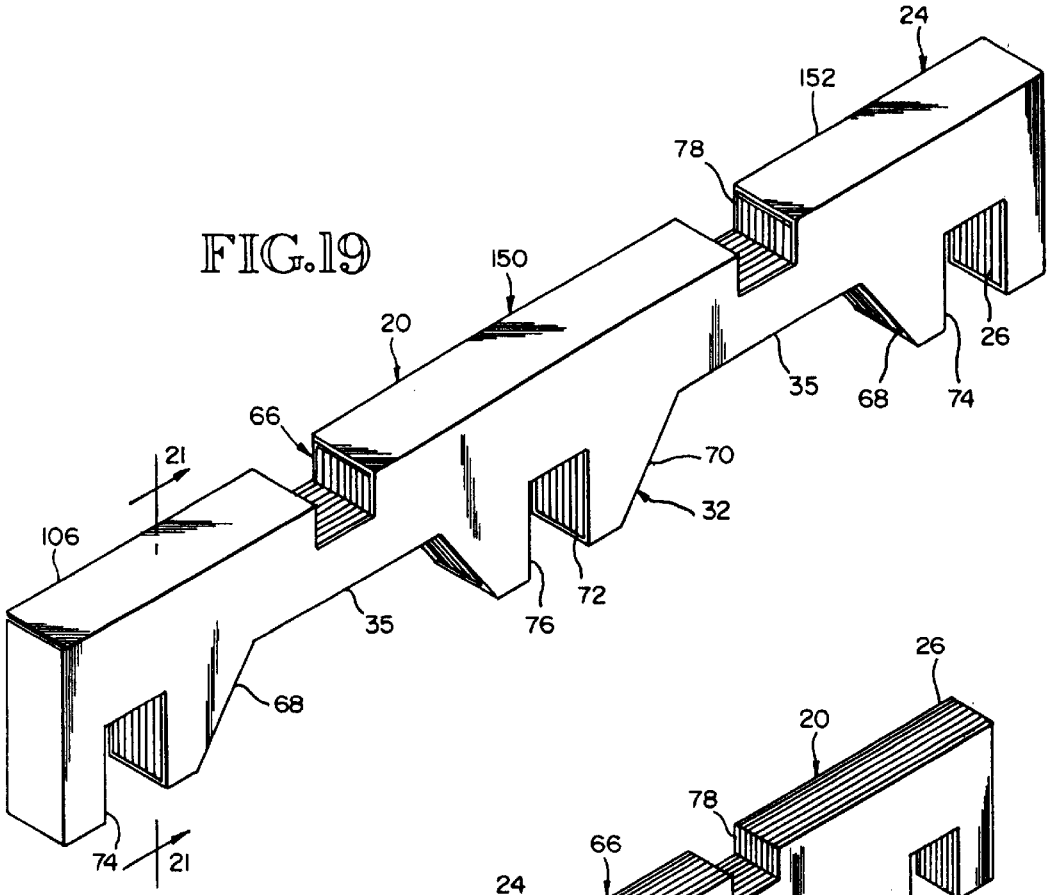

FIG. 19 is a perspective view of a major longitudinal member which has a surrounding sleeve of wall corrugated material.

Figure 5:
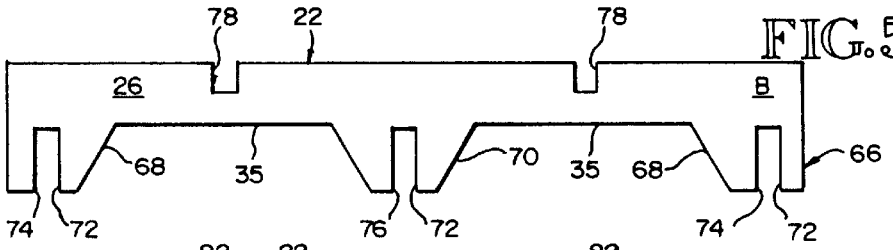
Figure 20:
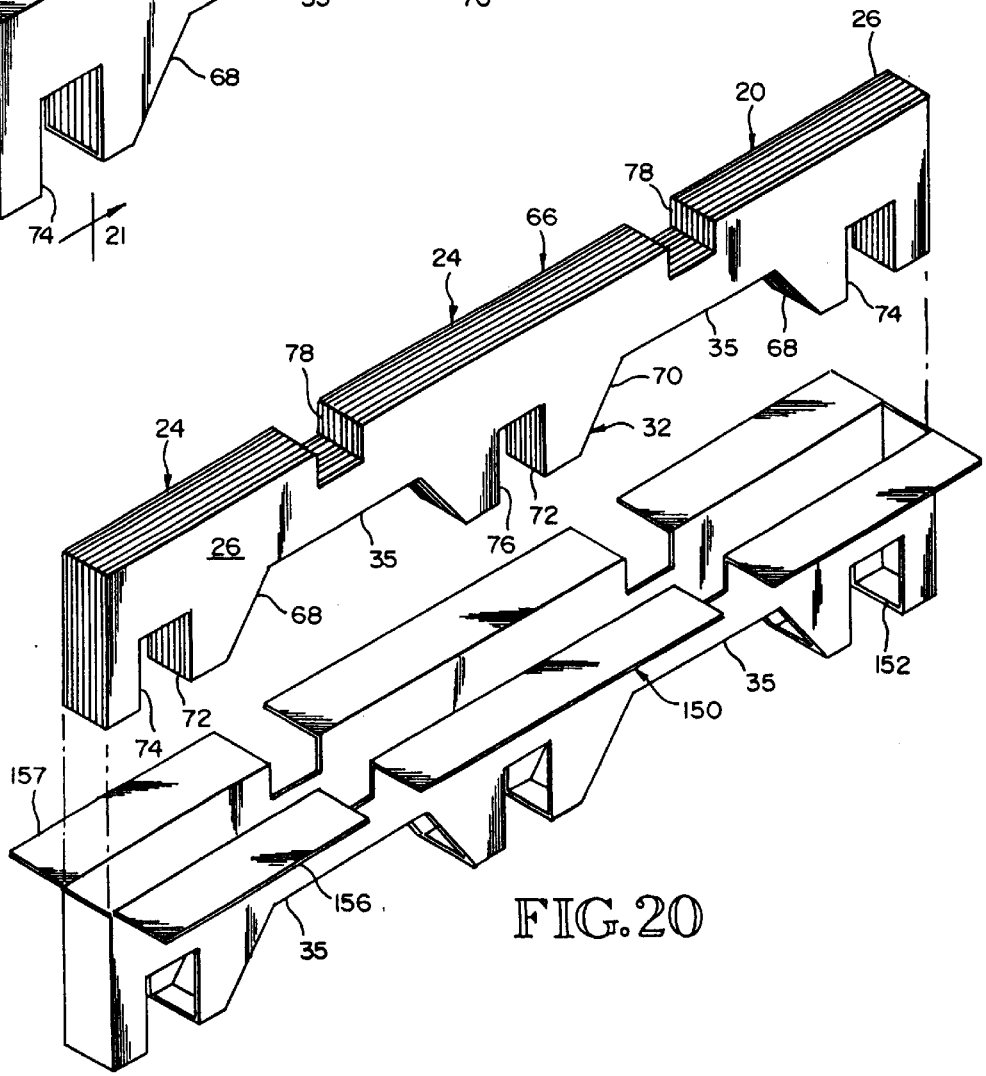

FIG. 20 is an exploded perspective view of the major longitudinal member shown in FIG. 19, illustrating how a major longitudinal member, as shown in FIG. 5, is fitted with a surrounding sleeve of wall corrugated material, to then appear as shown in FIG. 19.

Figure 21:
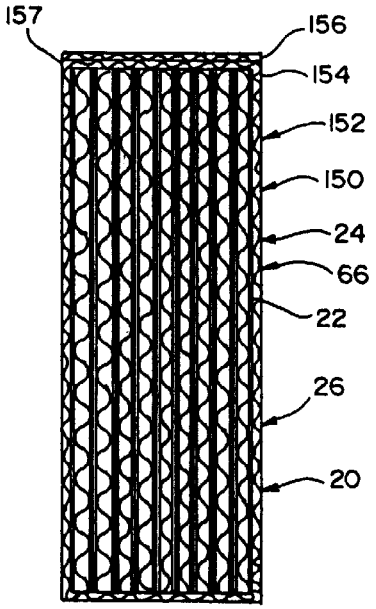

FIG. 21 is a cross sectional view of the major longitudinal member shown in FIG. 19, taken along section line 21—21 of FIG. 19, to illustrate the positioning of the surrounding sleeve of wall corrugated material, with the top of sleeve having overlapping portions of the wall corrugated materials, which may include interlocking portions.

Figure 22:
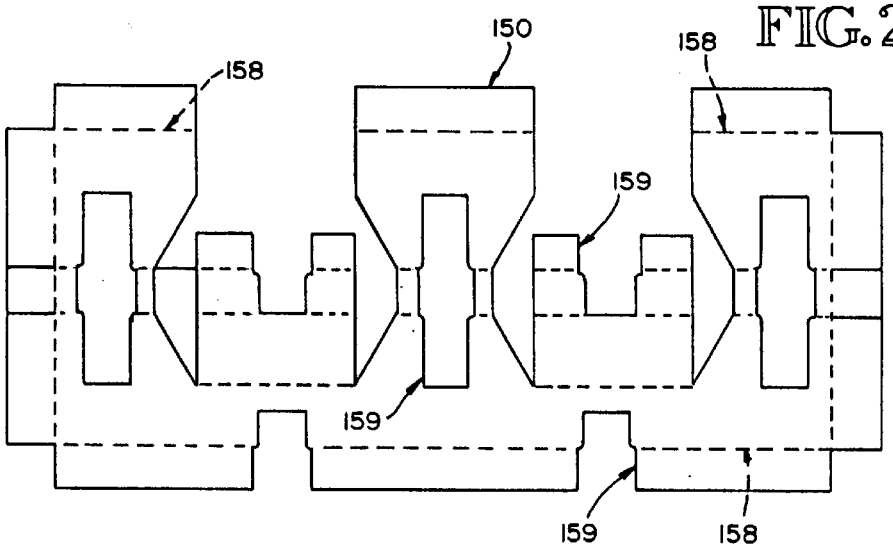

FIG. 22 is a top view of the planar arrangement of the die cut wall corrugated material, which is subsequently folded along bend lines and arranges as the surrounding sleeve for a major transverse member, shown in FIG. 4.

Figure 23:
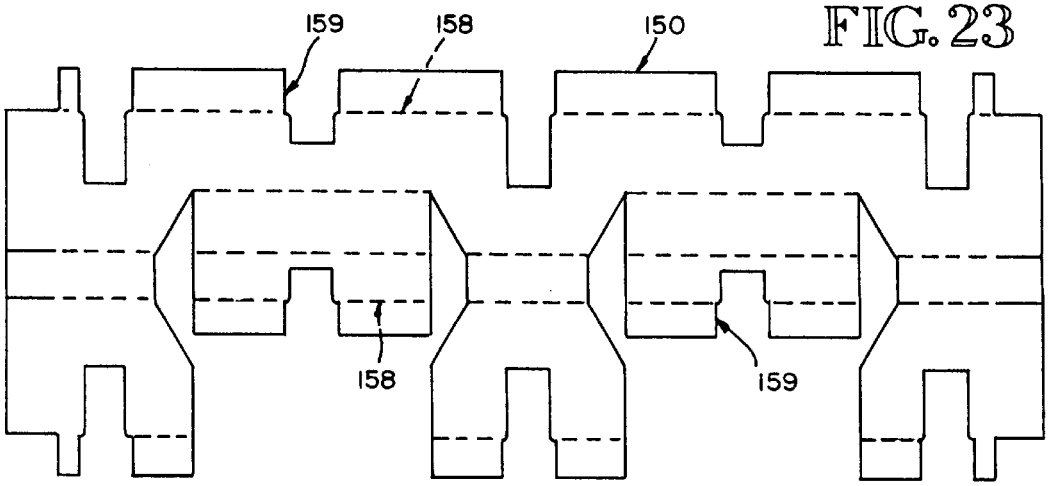

FIG. 23 is a top view of the planar arrangement of the die cut wall corrugated material, which is subsequently folded along bend lines and arranged as the surrounding sleeve for a major longitudinal member, as shown in FIG. 5.

Figure 24:
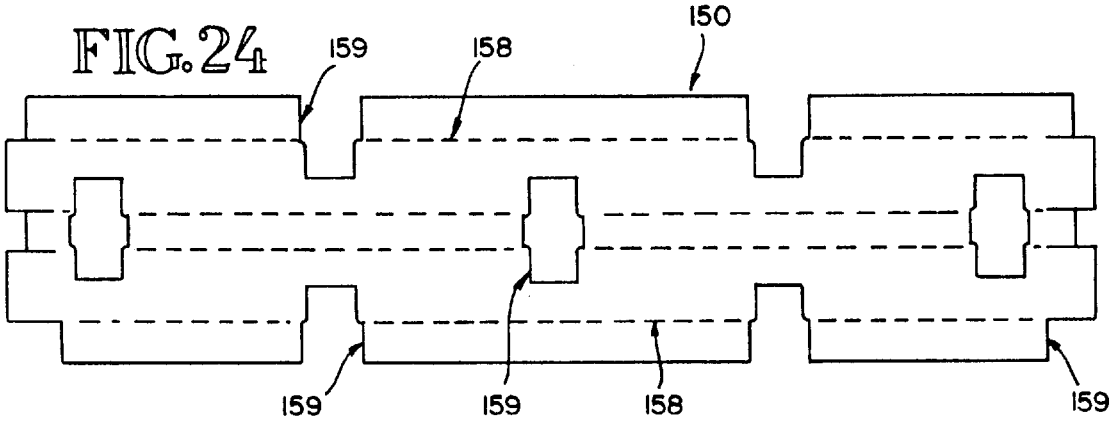

FIG. 24 is a top view of the planar arrangement of the die cut wall corrugated material, which is subsequently folded along bend lines and arranged as the surrounding sleeve for a minor longitudinal member, shown in FIG. 6.

Figure 25:
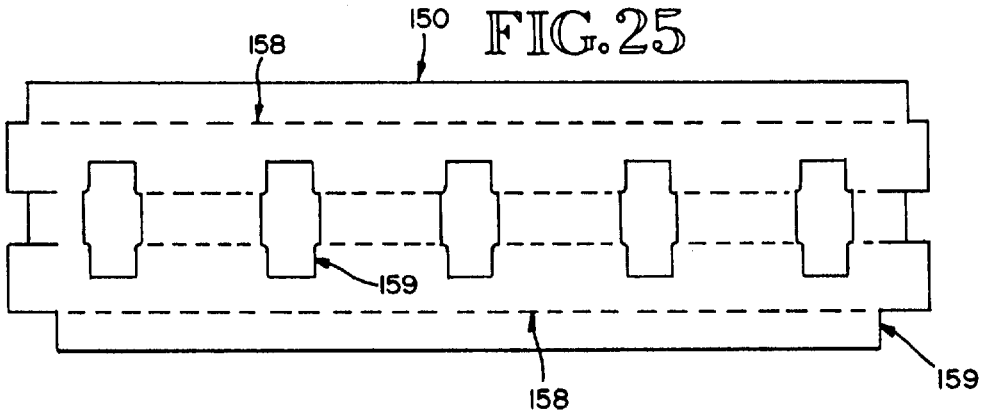

FIG. 25 is a top view of the planar arrangement of the die cut wall corrugated material, which is subsequently folded along bend lines and arranged as the surrounding sleeve for a minor transverse member, shown in FIG. 7.

Figure 26:
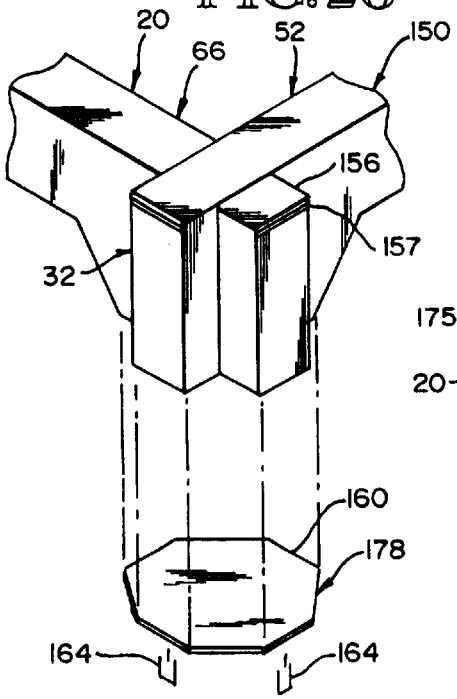

FIG. 26 is a perspective partial view of a corner portion of a corrugated cardboard pallet showing how the bottom of the leg is soon to be covered with a piece of material, which blocks the entry of liquids, and also serves as a protective sliding surface structure, when held in place, for example, by using staples.

Figure 27:
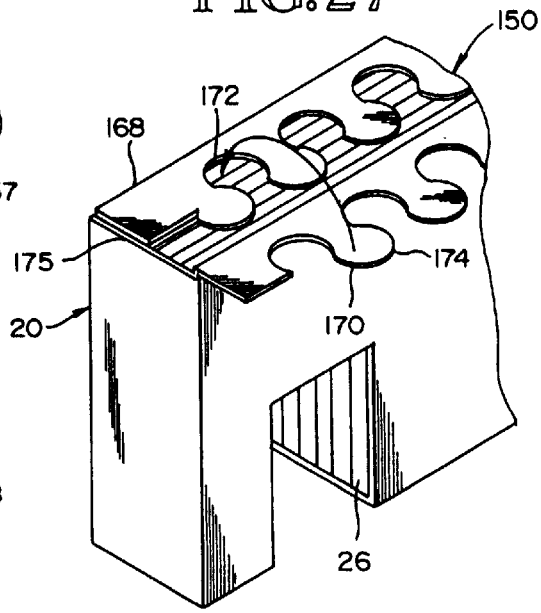
Figure 28:
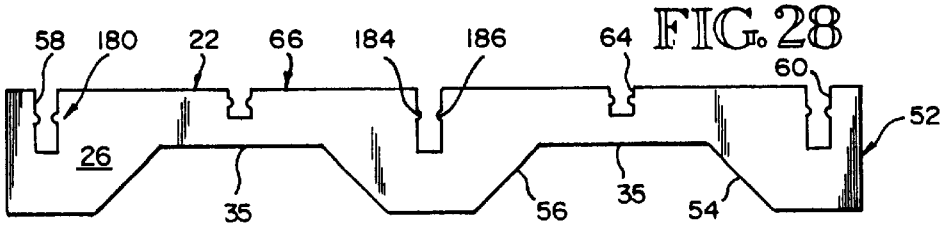
Figure 29:
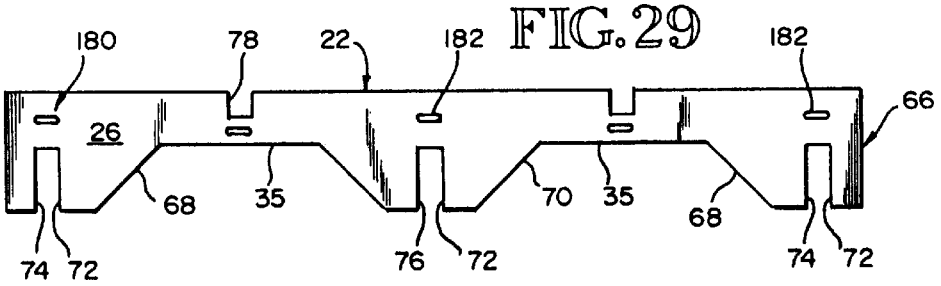
Figure 30:
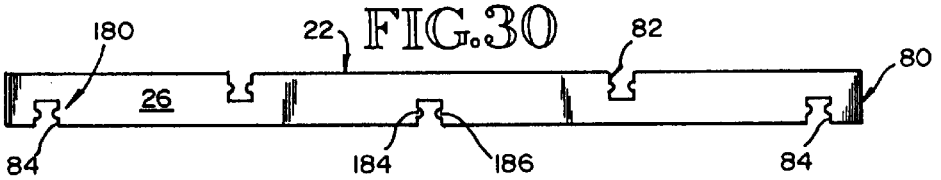
Figure 31:
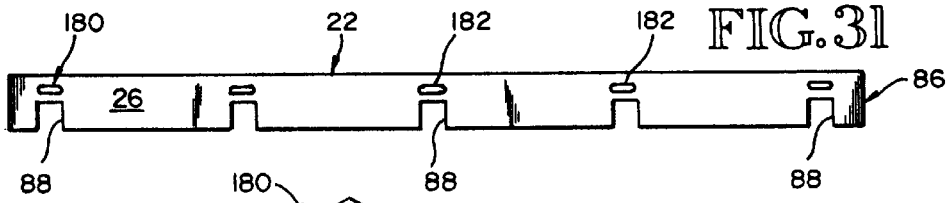

FIG. 27 is a perspective view of the end, for example, of the major longitudinal member, in reference to the location of section line 21—21 of FIG. 19, which illustrates how die cut locking assemblies, such as interfitting key-like cut-out portions, are interfitted along the top of the surrounding sleeve to keep the surrounding sleeve secured in place, and resulting in no overlapping portions of the wall corrugated materials.

Figure 3:
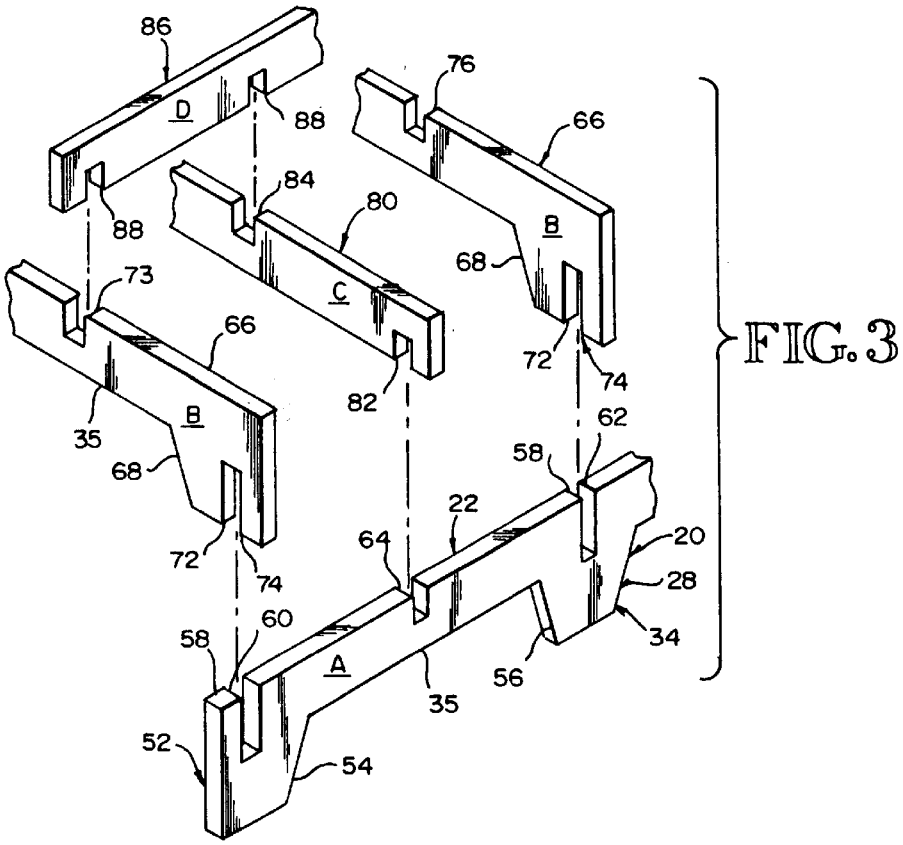
FIG. 3 is a partial exploded perspective view of portions of the respective various longitudinal members or components, and various transverse members or components indicating how they are arranged and then sequentially moved together to complete the respective main pallet support.

FIGS. 28 through 31 are similar to FIGS. 4 through 7, and FIG. 32 is similar to FIG. 3, except throughout all these FIGS. 28 through 32, the respective supporting members or components have respective additional die cuts which have created complementary arrangements of either locking slots or locking insertable spaced and opposed tab pairs, which, when the pallet is assembled, create the various spaced interfitting locking assemblies.

Figure 33:
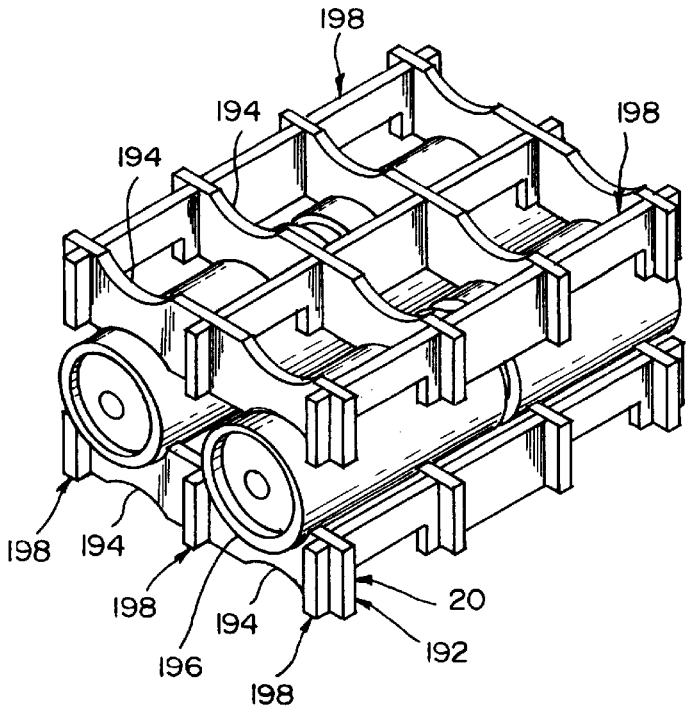
Figure 37:
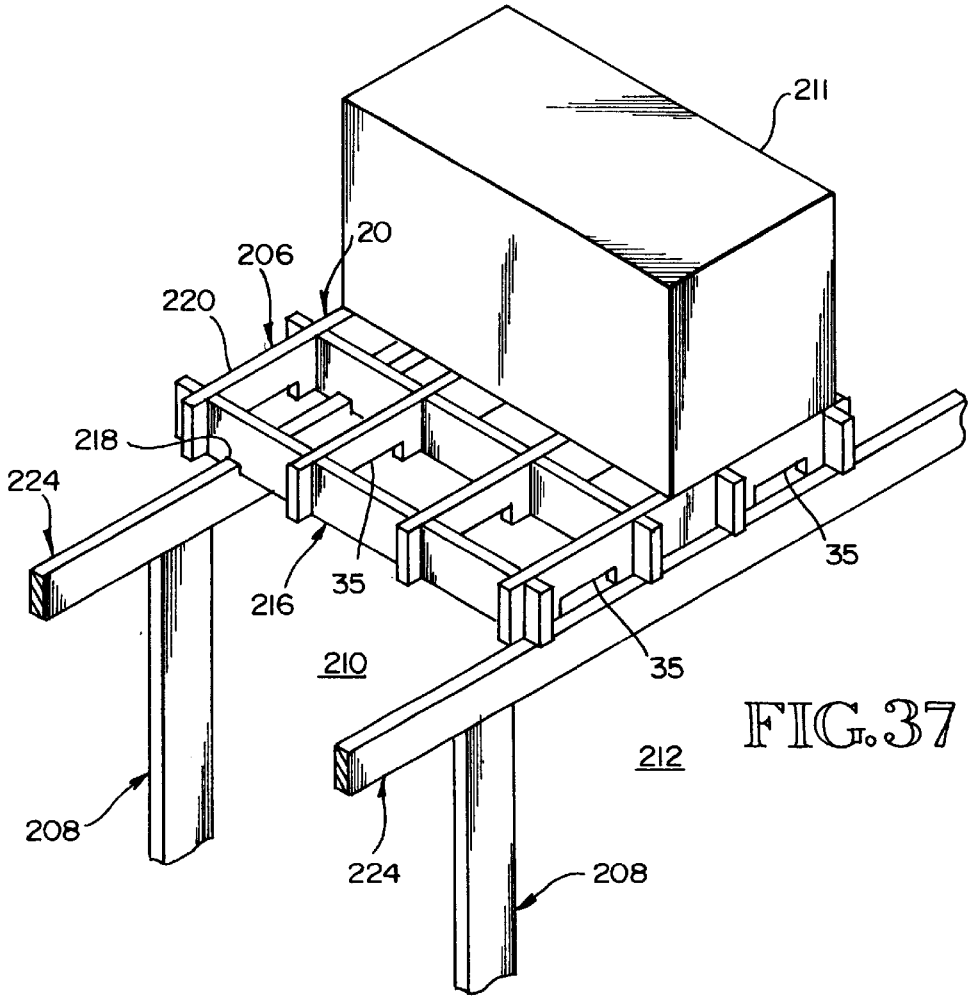

FIG. 33 is a partial perspective view of another embodiment of a main pallet support used to handle and to store cylindrical containers such as kegs of beer, with the transverse members of the pallet having spaced partial circumferential receiving surface structure to complementary position partial circumferentail portions of a cylindrical container, and with longitudinal members of the pallet having spaced rectangular receiving surface structures to accommodate the entry of respective tongs of a forklift;

FIG. 34 is a vertical elevational view of one of the transverse mambers of the main pallet shown in FIG. 33;

FIG. 35 is a vertical elevational view of one of the longitudinal members of the main pallet shown in FIG. 33;

FIG. 36 is a perspective view of the main pallet shown in FIG. 33, with dotted lines indicating portions of respective tongs of a forklift;

FIG. 37 is a partial perspective view of another embodiment of a main pallet support used to handle and to store heavy loads, where the main pallet supports are custom fitted to supporting spaced and open frames assemblies, which in turn are often spaced from one another to designate passageway which must remain clear;

FIG. 38 is a vertical elevational view of one of the longitudinal members of the main pallet shown in FIG. 37, illustrating a receiving notch like surface structure designed to partially fit over a transverse member of a supporting spaced and open frame assembly, arranged in a storage volume, in insure the main pallet is positioned correctly;

FIG. 39 is a vertical elevational view of one of the transverse members of the main pallet, shown in FIG. 37, which have spaced receiving channel like surface structures, designed to allow the entry of spaced tongs of a forklift, and subsequently to bear against the spaced tongs when a pallet load is being raised or lowered; and FIG. 40 is a perspective view of the main pallet, illustrated in FIGS. 37, 38, and 39, particularly showing the strong longitudinal members having the respective aligned receiving notch like surface structures, which subsequently, when the main pallet is used to carry and to store a load, help the operator of a forklift to accurately position the main pallet in reference to a transverse member of a supporting spaced and open frame assembly arranged in a storage volume.

DESCRIPTION OF THE PREFERRED EMBODIMENTS

The pallets 20 made of laminated die cut corrugated cardboard 22, or corrugated plastic board, with all the assembled major load supporting members 24, or components 24, having all the die cut laminations 26 arranged vertically, create strong and durable pallets 30, available in various sizes from interchangeable components to support various loads, as indicated in FIGS. 1 through 15. Also these members are illustrated in FIGS. 19 through 27, when they each include a surrounding sleeve of wall corrugated material.

In each embodiment, the overall assembled major load supporting members 24, or components 24, serve as the main pallet support 28. Some of the die cut corrugated cardboard 22, or corrugated plastic board, serving as respective laminations 26, integrally include lamination portions 30, which, when with other like lamination portions 30, comprise respective designed legs 32 of the main pallet support 28.

In FIGS. 1, 2, 10, and 15, the selected size pallet 20 has a main pallet support 28, arranged as a principal pallet 34, designed to support large loads, in a way broadly similar to the utilization of wood pallets. As shown in FIGS. 1 and 2, the principal pallet 34 has sufficient clearances creating openings 35 for receiving tongs, to allow the entry of extending tongs 36, as indicated by phantom lines, of a forklift and pallet jacks, approaching for a perpendicular entry under any side 38 of the principal pallet 34, with adequate overhead clearance and also side clearance between the nearest spaced pallet legs 32.

A possible cubic size overall pallet load 40 is indicated by the phantom lines in FIG. 1. As illustrated in FIGS. 1 and 2, the main pallet support 28 of this principal pallet 34, although sufficiently strong, may optionally be fitted with a floor 42, having depending sides 44, provided with openings 46, or cutouts 46, thereby providing for clearances around extending portions 48 of respective major loading supporting members 24.

The utilization of the floor 42 has two principal purposes; with one purpose being to keep smaller items, stored on a pallet 20, not shown, from falling down into spaces 50 formed by and surrounded by the major load supporting members 24; and with the other purpose being to firmly maintain the starting perpendicular positions of the respectively positioned an assembled major load supporting members 24, which are arranged to be either positioned longitudinally or transversely.

The different types of the major load supporting members 24, and how they are prearranged and then assembled, are illustrated in FIGS. 3 through 7.

Figure 4:
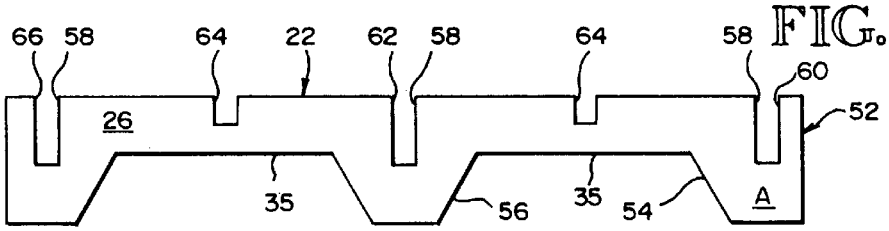

A major transverse member 52, or component 52, is shown in FIG. 4. When used in a principal pallet 34, as illustrated in FIGS. 1, 2, 3, 10 and 15, there are laminated leg portions 3 to form two end leg portions 54 and a central leg portion 56. Also there are larger depending cutouts 58, accessible from above, and located as respective end cutouts 60, and a central cutout 62. Moreover there are two smaller depending cutouts 64, spaced midway between larger depending cutouts 58.

A major longitudinal member 66 or component 66, shown in FIG. 5. When used in a principal pallet 34, as illustrated in FIGS. 1, 2, 3, 10, and 15, there are laminated leg portions 30 to form two end leg portions 68 and a central leg portion 70. Also there are larger upstanding cutouts 72, accessible from below, and located as respective end cutouts 74, and a central cutouts 76. Moreover, there are two smaller depending cutouts 78, spaced midway in respect to the larger upstanding cutouts 72.

Figure 6:
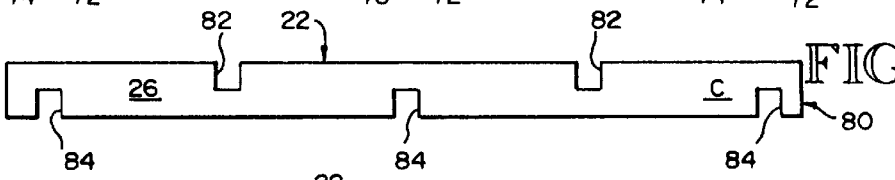

A minor longitudinal member 80, or component 80, is shown in FIG. 6. When used in a principal pallet 34, as illustrated in FIGS. 1, 2, 3, 10, and 15, there are no laminated leg portions 30. There are three upstanding smaller cutouts 82, accessible from below, with two of them being positioned near the ends, and one of them being positioned in the center, of this minor longitudinal member 80. Then there are two depending smaller cutouts 84, spaced respectively at the mid locations between the three upstanding smaller cutouts 82.

Figure 7:
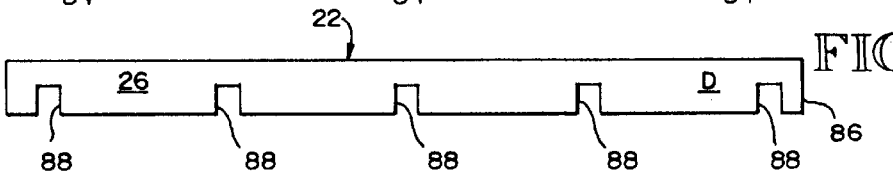

A minor transverse member 86 or component 86, is shown in FIG. 7. When used in a principal pallet 34, as illustrated in FIGS. 1, 2, 3, 10, and 15, there are no laminated leg portions 30. There are five upstanding smaller cutouts 88, accessible from below. Two of the five cutouts 88 are located near the respective ends, one is located at the middle, and two are located at the respective midpoints between a respective end cutout and a middle or center cutout, of this minor transverse member 86.

The respective sequential positioning and assembly of these major load supporting members 24 is illustrated in FIGS. 3 and 2, in respect to the principal pallet 34. Three major transverse members 52 are spaced apart and parallel one to the other. Then the three major longitudinal members 66 are spaced apart parallel one to the other, in their respective perpendicular directions, and respectively lowered down to engage and to interfit with the three major transverse members 52.

Thereafter, the two minor longitudinal members 80 are lowered to respectively engage and to interfit with the three major transverse members 52. Subsequently, the two minor transverse member 86 are lowered to engage and to interfit with all three major longitudinal members 66, and both the minor longitudinal members 80, to complete the main pallet support 28 of the principal pallet 34.

How some of these major load supporting members 24 of the main pallet support 28 of the principal pallet 34 interfit with one another is further illustrated in the partial cross sectional view of FIG. 8, which is taken along the line 8—8, as indicated in FIG. 1. In this FIG. 8, a side view of a portion of a minor transverse member 86 is shown extending between two major longitudinal members 66, while interfitted with them and also interfitted with one of the minor longitudinal members 80. An end leg portion 54, and a central leg portion 56 of a major transverse member 52 are both shown in this FIG. 8.

Also illustrated in FIG. 8 is the positioning of another embodiment 90 of a floor 90, which has depending sides 92, or flanges 92. In contrast to the floor 42 shown on FIG. 2, this floor 90 fully extends in all directions to fully cover all the top portions of the main pallet support 28. Also this floor 90 has respective depending sides 94 which are continuous. There is no need for cutouts. These depending sides however, do not cover any of the leg portions.

The flutes 94 of the corrugations 96 of the laminated die cut corrugated cardboard 22, or corrugated plastic board, as illustrated in FIG. 8, are parallel to one another in the same direction in all side by side die cut laminations 26, of the optionally selected five die cut laminations 26, which are secured together by using glue and some pressure in reference to corrugated cardboard 22, and by using heat and pressure in reference to the corrugated plastic board. In securing corrugated plastic board laminations together the pressure and heat that is utilized is undertaken by operating sonic welding equipment. Also, as illustrated in FIG. 9, the parallel flutes 94 in one die cut lamination 26, when secured to an adjacent die cut lamination 26, may, as a group 98, be arranged to be perpendicular in direction to a group 100 of parallel flutes 94 in the adjacent side cut lamination 26.

When a pallet 20, such as the principal pallet 34 illustrated in FIG. 10, is to be moved on a roller conveyor, not shown, or any type of conveyor, when legs 32 of the pallet 20, would possibly be caught up in the conveyor, then a corrugated full bottom 102 is secured to the pallet 20. If a pallet 20 having such a bottom 102, is subsequently expected to be handled by a pallet jack, not shown, then the bottom 102 is cut to provide holes 104 to accommodate the positioning of portions of the pallet jack, as shown in FIG. 10.

Other Pallets of Different Size and Configurations and Different Strength

In FIGS. 11 through 14, other pallets 20 of different sizes and configurations and different strengths, are illustrated to represent how various sizes and shapes of die cut laminations 26 of laminated die cut corrugated cardboard 22 or corrugated plastic board, are arranged to produce different pallets 20.

A strong smaller square pallet 106 is shown in FIG. 11. There are two major transverse members 108, and two major longitudinal members 110. Also there is one minor transverse member 112 and one minor longitudinal member 114.

A strong smaller rectangular pallet 116 is illustrated in FIG. 11. All the three major transverse members 108, and the two minor transverse members 112 are like those used in pallet 106, shown in FIG. 11. All the longitudinal members are longer. There are two major longitudinal members 118, and one minor longitudinal member 120.

A smaller square pallet 122 is illustrated in FIG. 13, which is used when less strength is required. Only one minor member is used, which is the minor longitudinal member 114.

A smaller rectangular pallet 124 is shown in FIG. 14, which is used when less strength is required. All the members are major members. There are no minor members. There are three major transverse members 108, and there are two major longitudinal members 118.

Preferably cutouts are still created, as shown in FIG. 14, when the die cut laminations are made, so minor members may be added at a subsequent time. Also as realized in observing all the illustrated pallets 20, there are several major load supporting members 24 which are alike. The availability of a supply of these interchangeable major load supporting members 24 serves as the basis of quickly making different sizes and strength of pallets 20.

The Storage Container Accessory for Use With a Selected Pallet

A storage container assembly 126 is provided as an accessory for handling, storage and shipping smaller items, not shown, which must be protected as a group within a full enclosure. The components of this accessory assembly 126 are illustrated in FIG. 15, as they are prearranged just before their final interfitting assembly. A bottom 128 with upturned sides 130 is sized to be placed atop the principal pallet 34, shown in FIG. 1. Then four walls 132 arranged together are positioned on the bottom 128 and confined in part by the upturned sides 130. When not in use, these four walls 132, as a group are arranged to be folded to substantially reach a near planar configuration. Thereafter a top 134 with depending sides 136 is lowered into place over the four walls 132. Preferably the bottom 128 and top 134 are identically made, and therefore are interchangeable. Also either this bottom 128 top of 134 may be used for the floor 90, which is illustrated in part in FIG. 8. Pallet straps, not shown, may be used to surround this storage container assembly 126, and portions of the pallet 20, to hold all these parts together.

Also when a bottom 128 is to be a part of a storage container assembly 126, then a floor 42 may not be considered necessary.

When the storage container assembly 126 is not being used, the four walls 132 as a group are arranged to be folded to substantially reach a near planar configuration, which is then confined between the bottom 128 and the top 134 for convenient handling and storage, until the storage container assembly 126 is to be used again.

Plastic Pallet Leg Covers are Used When These Pallets Made of Corrugated Cardboard Are to be Utilized in Places Where Moisture and/or Water and/or Other Liquids May Collect on a Supporting Surface When these pallets 20 are made of laminated die cut corrugated cardboard, their legs 32 are often covered with removable snug fitting plastic covers 138, which are used to keep supporting surface water or other liquids from entering into the die cut laminations 26 of the laminated die cut corrugated cardboard 22, i.e. from entering into this pallet 20.

These removable snug fitting plastic covers 138 are formed to be corner leg positioned plastic covers 140, outer midpoint leg positioned plastic covers 142, and central midpoint leg positioned plastic covers 144, as respectively illustrated in FIGS. 16, 17 and 18.

Additional embodiment Wherein Both the Longitudinal and Transverse Members Made of Vertically Positioned Side by Side Adhered Lamination Include Surrounding Sleeves of Wall Corrugated Materials To enhance the strength, durability, and/or sliding features of these pallet, both the longitudinal and transverse members, made of vertically positions side by side adhered laminations are each covered by surrounding sleeves 140, preferably made of wall corrugated materials, which are generally single wall corrugated materials 152.

In FIGS. 19 and 20, the covering of a major longitudinal members 66 is illustrated, with FIG. 20 showing the surrounding sleeve 150 positioned to receive the major longitudinal member 66, and with FIG. 19 illustrating the resulting interfitting of these members, 150 and 66.

The resulting cross sectional structure of this sized major longitudinal member 66, when so covered by a surrounding sleeve 150 made of a single wall corrugated material 152, is illustrated in FIG. 21. Around the bottom and sides of the surrounding sleeve 150 is a single wall corrugated material 152. At the top, the side materials are continued on and then directly folded over the top, resulting in the double layers of the single wall corrugated material 152. As noted in FIG. 21, on one side, this single wall corrugation 152 is extended upwardly the distance 154 of the thickness of the first folded single wall corrugated material 152. Thereafter upon folding the second folded position 156 closely overlays the first folded portion 157. These overlaps may include die cut locking assemblies.

The respective size and shaped surrounding sleeves 150 of wall corrugated materials 152 are each arranged in a planar die cut configuration as illustrated in FIGS. 22 through 25. In FIG. 22 the surrounding sleeve 150 will be fitted to a major transverse member 52. The surrounding sleeve 150, shown in FIG. 23, will be fitted to a major longitudinal member 66. In FIG. 24, the surrounding sleeve 150 will be fitted to a minor longitudinal member 80. The surrounding sleeve 150, shown in FIG. 25, will be fitted to a minor transverse member 86.

Throughout FIGS. 22 through 25, the dotted lines are the bend lines or fold lines 158. The various cutouts 159 of respective sizes are determined by the various die cuts of the various major load supporting members 24.

These respective sized and shaped surrounding sleeves 150 add to the overall strength of a respective pallet 20. They also provide a protective cover the laminations of the corrugations, and keep the laminations together. They are made of single wall corrugated material 152.

Securement of Soles on the Feet of Respective Pallets

When corrugated cardboard is laminated parts 22 is utilized in forming the respective feet of a pallet 20, and sliding movements of the pallet 20 are expected, and/or placement of the pallet 20 on damp floors is expected, then a sole 160 made of preferably plastic material, and also preferably made of at least a single wall structure, is secured to each foot 162. Staples 164, for example, may be used to secure each sole 160 in place on each foot 162, as illustrated in FIG. 26.

Securing the Surrounding Sleeves to the Respective Major Load Supporting Members of the Pallet As noted in viewing FIG. 21, at the top of as respective major load supporting member 24, i.e. the major longitudinal member 66, shown in FIG. 19, 20, and 21, two overlapping folded portions 156, 158 of single wall corrugated cardboard are secured to one another to complete the securement of the surrounding sleeve 150, illustrated in FIG. 23.

Another way to secure a surrounding sleeve 150, is shown in FIG. 27. There are die cut locking assemblies comprising two interfitting portions 169, 170, which when folded down and then being interlocked together, complete the securement of the surrounding sleeve 150. Each of these interfitting portions have like designed and sized key-like spaces openings 172 on portion 168 and 174 on portion 170, which when arranged in the same plane interlock together to complete a single wall top 175 of the surrounding sleeve 150. These die out locking assembles could be modified.

The Utilization of Materials

Currently corrugated cardboard 176 is available in sufficient quantities for high production of pallets 20 having major load supporting members 24, which in turn are made of laminated die cut corrugated cardboard 24. Then when moisture and/or water is to be expected on floors and other supporting surfaces, waterproof components such as those made of plastic, serves as accessories to be fitted to the legs 32 of the pallets 20, as illustrated in FIGS. 16, 17, 18 and 26.

Recently a corrugated plastic board 178 is available, and a sole plastic material 160 is made from this corrugated plastic board 178, as illustrated in FIG. 26. Also other portions and/or all portions of pallets 20 may be made of this corrugated plastic board 178.

Supporting Members or Components Having Various Interfitting Locking Assemblies

Figure 32:
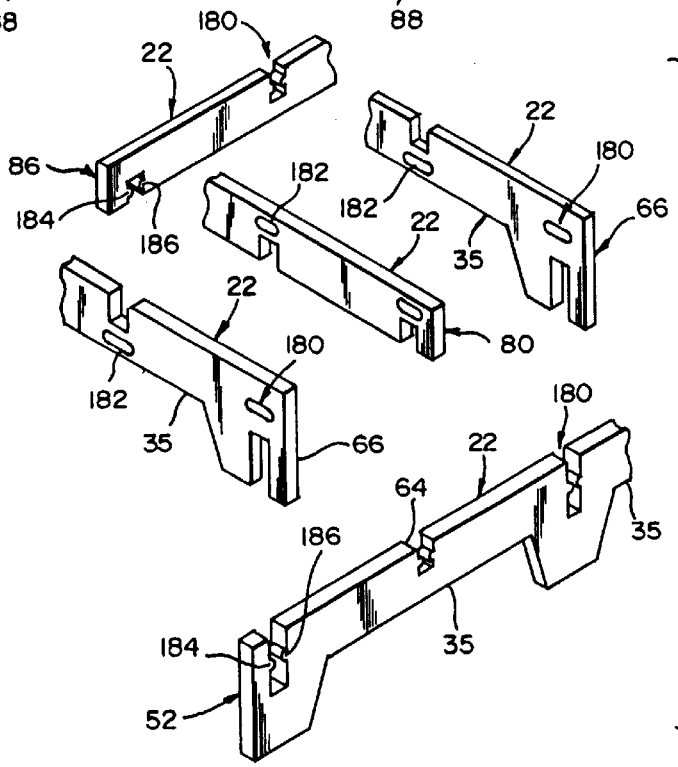

Interfitting locking assemblies 180 are indicated in FIGS. 28 through 31, which are similar to FIGS. 4 through 7, and in FIG. 32, which is similar to FIG. 3. Each of the supporting members or components have portions of various spaced interfitting locking assemblies 180, which are created when a respective pallet 20 is assembled.

The respective supporting members or components have respective additional die cuts which have created complementary arrangements of either locking slots 182, or locking insertable spaced and opposed tab pairs 184, 186. Then, when the pallet 20 is assembled, these respective additional die cuts are interfitted to create the various spaced interfitting locking assemblies 178.

These Shipping Pallets and Accessories Therefore Made of Corrugated Cardboard and Corrugated Plastic Board Are Readily Customized to Meet the Specifications of a Partial Customer Although predesigned and offered shipping pallets 20 made of corrugated cardboard 22 and/or corrugated plastic board 173, are ready for filling orders, on occasions customers order other shipping pallets 20 with special features to meet their respective special needs, i.e. customized shipping and storage pallets 20.

For example, a brewery wanted these shipping and storage pallets 20, in an embodiment 190 to lift, lower, store and transport kegs of beer. This embodiment 190 is illustrated in FIGS. 33 through 36. The transverse major load supporting members 192 have spaced partial circumferential receiving surface structures 194 to complementary position circumferential portions of a cylindrical container 196, i.e. a beer keg 196, positioned either on the pallet 20, or the pallet 20 is placed on the top of the beer keg 196, to position an additional level of beer kegs 196, as particularly shown in FIG. 33.

The longitudinal major load supporting mambers 198 have the spaced rectangular receiving surface structures to accommodate the entry of the respective spaced tongs 36 of a forklift.

These transverse and longitudinal major load supporting members 192, 198 of this embodiment 150 for beer kegs 196, or with the partial receiving surface structures 194 being modified to position other containers, of the of different cross sectional shapes, have their various receiving openings resulting from the die cutting of their respective portions, used during their assembly. This assembly is undertaken in the same way as illustrated in FIGS. 3 through 5, in respect to the major receiving openings, i.e. major receiving slots, either being slots 200 open at the top or slots 202 open at the bottom, as indicated in FIGS. 34 and 35.

Another example of a customized shipping and storage pallet 20 is the embodiment 206, illustrated in FIGS. 37 through 40. The customer already had spaced rows of supporting spaced and open frame assemblies 208 in a storage volume 210, and these assemblies 208 were spaced apart at various locations to define the boundaries of an aisle 212 through which the forklift operated.

Therefore the customer wanted stronger longitudinal load support members 216 to span across the openings and the customer gave up one of the two directions available for approaching tongs 36 of forklift. Moreover, the customer wanted these stronger longitudinal major load support mambers 216 to have at least one respective aligned receiving notch like surface structure 218. Therefore on the spaced side by side stronger longitudinal major load support members 216, there are alignable receiving notch like surface structures 218, which slip down over respective portions of a transverse member 224 of the supporting spaced and open frame assembly 208 arranged in the storage volume 210.

When this accurate positioning of this embodiment 206 of a pallet 20 is undertaken, and if the pallet 20 is loaded properly, then the correct open width of an aisle 212 is maintained for the passage of forklifts, etc.

This embodiment 206, of the pallet 20, has transverse members 220, each having openings 35 for receiving tongs 36 of a forklift.

These two embodiments 190 and 206 are representative of other embodiments, not illustrated nor described, that are available or will be available to meet the special requirements of a particular customer, who prefers to order a custom designed pallet 20 made of corrugated cardboard and/or corrugated plastic board in laminated embodiments, as indicated by the various figure and various descriptions of these pallets 20.

I claim:

1. A pallet of corrugated cardboard, or corrugated plastic board, comprising:

a. longitudinal major load supporting members are spaced apart and arranged parallel to one another;

b. transverse major load supporting members are spaced apart and arranged parallel to one another;

c. wherein each major load supporting member compromises at least two die cut laminations of corrugated cardboard, or corrugated plastic board arranged vertically and adhered together;

d. wherein each major load supporting member has interfitting die cutouts positioned, so these longitudinal direction and transverse direction major load supporting members are assembled in a same horizontal plane;

e. wherein each major load supporting member has, in addition, surrounding sleeves made of corrugated plastic board; and f. wherein each surrounding sleeve is secured by interlocking key hole cutouts formed in board portions, which are folded to occupy portions of the surrounding sleeve at the top major load supporting member.

2. A pallet made of corrugated cardboard, or corrugated plastic board, comprising:

a. at least two longitudinal major load supporting members are spaced apart and arranged parallel to one another;

b. at least two transverse major load supporting members are spaced apart and arranged parallel to one another;

c. wherein each major load supporting member comprises at least two side by side die cut laminations of corrugated cardboard, or corrugated plastic board arranged vertically and adhered together;

d. wherein each major load supporting member has die cutouts positioned, so these longitudinal direction and transverse direction major load supporting members are assembled in a same horizontal plane;

e. wherein each major load supporting member has die cut depending leg portions, serving to position the pallet, so tongs of a forklift may be used in lifting the pallet; and f. wherein the major load supporting members have respective additional die cuts that create respective portions of interfitting locking assemblies, with some major load supporting members having complementary arrangements of locking slots of these assemblies, and some major load supporting members having complementary arrangements of locking insertable spaced and opposed tab paris of these assemblies, whereby, when this pallet is assembled, these respective additional die cuts of locking slots and locking insertable spaced and opposed tab pairs are interfitted to create various spaced interfitting locking assemblies, thereby, keeping the major load supporting members locked together.

* * * * *